US006254365B1

(12) United States Patent
Nakanishi

(10) Patent No.: US 6,254,365 B1
(45) Date of Patent: Jul. 3, 2001

(54) COMPRESSOR

(75) Inventor: Shigeo Nakanishi, Daito (JP)

(73) Assignee: Funai Electric Co., Ltd., Osaka (JP)

( * ) Notice: Subject to any disclaimer, the term of this patent is extended or adjusted under 35 U.S.C. 154(b) by 0 days.

(21) Appl. No.: 09/364,333

(22) Filed: Jul. 30, 1999

(30) Foreign Application Priority Data

May 26, 1999 (JP) ..... 11-147105

(51) Int. Cl.[7] ..... F04B 39/00; F04B 53/00

(52) U.S. Cl. ..... 417/572; 62/175

(58) Field of Search ..... 62/196.4, 175, 62/238.4; 418/55, 60, 63, 55.4, 11; 417/572

(56) References Cited

U.S. PATENT DOCUMENTS

| | | | | |
|---|---|---|---|---|
| 4,344,297 | * | 8/1982 | Ueno et al. | 62/196.3 |
| 4,596,521 | * | 6/1986 | Murayama et al. | 418/55 |
| 5,094,085 | * | 3/1992 | Irino | 62/175 |
| 5,102,317 | * | 4/1992 | Okoma et al. | 418/60 |
| 5,183,400 | * | 2/1993 | Tada et al. | 417/572 |
| 5,214,932 | * | 6/1993 | Abdelmalek | 62/238.4 |
| 5,261,800 | * | 11/1993 | Sakae | 418/63 |
| 5,263,822 | * | 11/1993 | Fujio | 418/55.4 |
| 5,322,424 | * | 6/1994 | Fujio | 418/11 |
| 5,616,017 | * | 4/1997 | Iizuka et al. | 418/63 |
| 5,800,150 | * | 9/1998 | Onoda et al. | 418/63 |
| 6,062,834 | * | 5/2000 | Masumoto et al. | 418/55.4 |

FOREIGN PATENT DOCUMENTS

| | | |
|---|---|---|
| 63-036075 | 2/1988 | (JP) . |
| 63-314382 | 12/1988 | (JP) . |
| 63-314383 | 12/1988 | (JP) . |
| 63-314388 | 12/1988 | (JP) . |

* cited by examiner

*Primary Examiner*—Teresa Walberg
*Assistant Examiner*—Leonid Fastovsky
(74) *Attorney, Agent, or Firm*—Lackenbach Siegel Marzullo Aronson & Greenspan

(57) ABSTRACT

A compressor capable of reducing the number of components and simplifying a step of forming a connection hole is obtained. In this compressor, a connection hole of a casing is formed substantially flush with the outer surface of the casing without projecting from the outer surface of the casing. Thus, the connection hole is formed by only perforation with no requirement for burring or the like, whereby the step of forming the connection hole is simplified. In this compressor, a refrigerant flow pipe of an accumulator is inserted into a refrigerant suction port. Thus, no pump liner (connection pipe) is required for connecting the refrigerant flow pipe and the refrigerant suction port, and the number of components is reduced.

16 Claims, 11 Drawing Sheets

COMPRESSOR

BACKGROUND OF THE INVENTION

1. Field of the Invention

The present invention relates to a compressor, and more particularly, it relates to a pipe connection structure of a compressor.

2. Description of the Prior Art

In general, a closed rotary compressor forming a refrigerant cycle is known as a compressor employed for an air conditioner or the like. For example, Japanese Patent Laying-Open No. 63-36075 (1988) discloses such a rotary compressor. FIG. 18 is a longitudinal sectional view showing the overall structure of the conventional rotary compressor disclosed in the above gazette, and FIG. 19 is an enlarged sectional view showing a pipe connecting portion of the conventional rotary compressor shown in FIG. 18.

Referring to FIG. 18, a conventional rotary compressor 101 has a motor (electric element) 103 arranged in an upper portion of an iron body shell (casing) 102. A compression element 105 is coupled to a lower portion of the motor 103 through a crankshaft 104. An accumulator 130 is arranged on a side portion of the rotary compressor 101.

With reference to FIGS. 18 and 19, the structure of the pipe connecting portion of the conventional rotary compressor 101 is now described in detail. The iron body shell 102 is provided with a connection hole 102*a* projecting outward from the outer surface of the body shell 102. Such an outwardly projecting connection hole 102*a* is formed by perforating a portion of the body shell 102 for forming the connection hole 102*a* and thereafter performing burring. An iron body liner 122 is engaged into the connection hole 102*a* formed in the aforementioned manner. The iron body liner 122 is fixed to the projecting end surface of the connection hole 102*a* by brazing 141. The body liner 122 relaxes transmission of vibration of the body shell 102 to a refrigerant flow pipe 131 of the accumulator 130.

An iron pump liner 123 for connecting the refrigerant flow pipe 131 with a refrigerant suction port 110 is inserted into the body liner 122. An end of the pump liner 123 is press-fitted into the refrigerant suction port 110 having a uniform inner diameter over the whole, while the refrigerant flow pipe 131 is inserted into the other end of the pump liner 123. The pump liner 123 of iron and the refrigerant flow hole 131 of copper are fixed to the body liner 122 of copper by brazing 142.

In the pipe connection structure of the aforementioned conventional rotary compressor 101, however, the number of components is disadvantageously increased due to the triple structure of the refrigerant flow pipe 131, the pump liner 123 and the body liner 122. Further, burring or the like must be performed in addition to perforation in order to form the connection hole 102*a* in the outwardly projecting shape, and hence the step of forming the connection hole 102*a* is disadvantageously complicated.

In this regard, a pipe connection structure reducing the number of components by omitting the body liner 122 and the pump liner 123 is proposed in general. For example, Japanese Patent Laying-Open No. 7-117042 (1995) or 7-117043 (1995) discloses such a structure. In the proposed pipe connection structure, however, the connection hole 102*a* of the body shell (casing) 102 projects outward, and burring or the like must be performed after perforation for forming this shape. Although the number of components can be reduced to some extent in this structure, it is difficult to solve the problem that the step of forming the connection hole 102 is complicated.

Thus, it is generally difficult to provide a compressor which can reduce the number of components while simplifying a step of forming a connection hole of a casing.

SUMMARY OF THE INVENTION

An object of the present invention is to provide a compressor which can reduce the number of components while simplifying a step of forming a connection hole.

Another object of the present invention is to provide a compressor which can smoothly and readily press-fit a refrigerant flow pipe of an accumulator into a refrigerant suction port of a compression element.

A compressor according to an aspect of the present invention comprises a compression element and a casing. The compression element has a refrigerant suction port connected with a refrigerant flow pipe of an accumulator. The casing is formed to enclose the compression element, and has a connection hole in a portion opposed to the refrigerant suction port. The connection hole is formed substantially flush with the outer surface of the casing without projecting from the outer surface of the casing. A forward end portion of the refrigerant flow pipe of the accumulator is inserted into the refrigerant suction port of the compression element, and fixed to the casing. In the compressor according to this aspect, the connection hole of the casing is formed substantially flush with the outer surface of the casing without projecting from the outer surface of the casing as described above so that the connection hole is formed only by perforation with no requirement for burring or the like, whereby the step of forming the connection hole can be simplified. Further, the refrigerant flow pipe of the accumulator is inserted into the refrigerant suction port to require no pump liner (connection pipe) for connecting the refrigerant flow pipe with the refrigerant suction port, whereby the number of components and the number of assembly steps can be reduced. In the structure according to this aspect of the present invention, therefore, it is possible to provide a compressor which can reduce the number of components and simplify a step of forming a connection hole.

In the structure of the compressor according to the aforementioned aspect of the present invention, the inner surface of the refrigerant suction port may include a tapered part and the forward end portion of the refrigerant flow pipe of the accumulator may include a chamfered part, so that the refrigerant flow pipe is press-fitted into the tapered part of the refrigerant suction port. According to this structure, the tapered part of the refrigerant suction port absorbs dispersion of the outer diameter of the refrigerant flow pipe when the refrigerant flow pipe is press-fitted into the refrigerant suction port, whereby a substantially uniform press-fit margin can be obtained even if the outer diameter of the refrigerant flow pipe is dispersed. If the refrigerant flow pipe is press-fitted into a straight refrigerant sunction port having no tapered part, the forward end portion of the refrigerant flow pipe may be stripped off and pulverized into fine crushed powder (foreign matter), which may exert a bad influence on the performance of the compressor when entering the compressor. According to the structure of the present invention, the forward end portion of the refrigerant flow pipe can be effectively prevented from being stripped off by providing the tapered part on the refrigerant suction port while providing the chamfered part on the forward end portion of the refrigerant flow pipe. According to this structure, therefore, the refrigerant flow pipe of the accumulator can be smoothly and readily press-fitted into the refrigerant suction port. In this structure, further, a portion of the compression element opposed to the connection hole may include a flat surface part. According to this structure, the accuracy of the tapered part can be readily checked with reference to the flat surface part after formation of the tapered part, so that the accuracy of the tapered part can be kept substantially uniform.

The compressor according to the aforementioned aspect may further comprise a cylindrical body inserted into the connection hole and fixed to the casing, so that the forward end portion of the refrigerant flow pipe of the accumulator passes through the cylindrical body and is press-fitted into the refrigerant suction port and fixed to the casing through the cylindrical body. According to this structure, the cylindrical body can relax transmission of vibration of the casing to the refrigerant flow pipe of the accumulator. In this structure, part of the cylindrical body may project inward into the casing. According to this structure, part of a brazing filler metal for brazing the cylindrical body to the outer surface of the casing penetrates into the casing from the outer surface thereof through the connection hole of the casing, and the penetrating part of the brazing filler metal is located between the surface of the projecting part of the cylindrical body and the inner surface of the casing. Thus, the cylindrical body and the casing are brazed to each other on both the outer and inner surfaces of the casing, whereby bonding strength between the cylindrical body and the casing can be improved. In this structure, the cylindrical body may be made of copper, the refrigerant flow pipe of the accumulator may be made of copper and the casing may be made of iron, for fixing the casing and the cylindrical body to each other by brazing with silver solder while fixing the cylindrical body and the refrigerant flow pipe of the accumulator to each other by brazing with phosphor copper solder. According to this structure, the casing and the cylindrical body as well as the cylindrical body and the refrigerant flow pipe can be fixed to each other by brazing having excellent workability with no requirement for large-scale equipment. In this structure, the cylindrical body may be made of copper, the refrigerant flow pipe of the accumulator may be made of iron and the casing may be made of iron for fixing the casing and the cylindrical body to each other by brazing with silver solder while fixing the cylindrical body and the refrigerant flow pipe to each other by brazing with silver solder. According to this structure, the casing and the cylindrical body as well as the cylindrical body and the refrigerant flow pipe can be fixed to each other by brazing having excellent workability with no requirement for large-scale equipment, similarly to the above. In this structure, two portions are brazed with single type of brazing filler metal (silver solder), whereby the workability of the brazing step can be improved as compared with the aforementioned case of employing two types of brazing filler metals. In this structure, the inner surface of the refrigerant suction port may include a tapered part and the forward end portion of the refrigerant flow pipe of the accumulator may include a chamfered part, so that the refrigerant flow pipe of the accumulator is press-fitted into the tapered part of the refrigerant suction port. In this structure, further, a portion of the compression element opposed to the connection hole may include a flat surface part.

In the structure of the compressor according to the aforementioned aspect, the forward end portion of the refrigerant flow pipe of the accumulator may pass through the connection hole and may be press-fitted into the refrigerant suction port and directly fixed to the casing. When the refrigerant flow pipe of the accumulator is thus inserted into the refrigerant suction port, no pump liner (connection pipe) is required for connecting the refrigerant flow pipe and the refrigerant suction port. When the refrigerant flow pipe is directly fixed to the casing, further, no body liner is required. Consequently, the number of components as well as the number of assembly steps can be further reduced. In this structure, further, the refrigerant flow pipe of the accumulator may be made of copper and the casing may be made of iron for fixing the casing and the refrigerant flow pipe of the accumulator to each other by brazing with silver solder. According to this structure, the casing and the refrigerant flow pipe can be fixed to each other by brazing having excellent workability with no requirement for large-scale equipment. In this structure, further, the refrigerant flow pipe of the accumulator may be made of iron and the casing may be made of iron for fixing the casing and the refrigerant flow pipe of the accumulator to each other by welding. According to this structure, the casing and the refrigerant flow pipe can be fixed by welding having excellent bonding strength, thereby improving the bonding strength between the casing and the refrigerant flow pipe. In this structure, the inner surface of the refrigerant suction port may include a tapered part and the forward end portion of the refrigerant flow pipe of the accumulator may include a chamfered part so that the refrigerant flow pipe of the accumulator is press-fitted into the tapered part of the refrigerant suction port. In this structure, further, a portion of the compression element opposed to the connection hole may include a flat surface part.

The foregoing and other objects, features, aspects and advantages of the present invention will become more apparent from the following detailed description of the present invention when taken in conjunction with the accompanying drawings.

DESCRIPTION OF THE PREFERRED EMBODIMENTS

Embodiments of the present invention are now described with reference to the drawings.

(First Embodiment)

Figure 1:
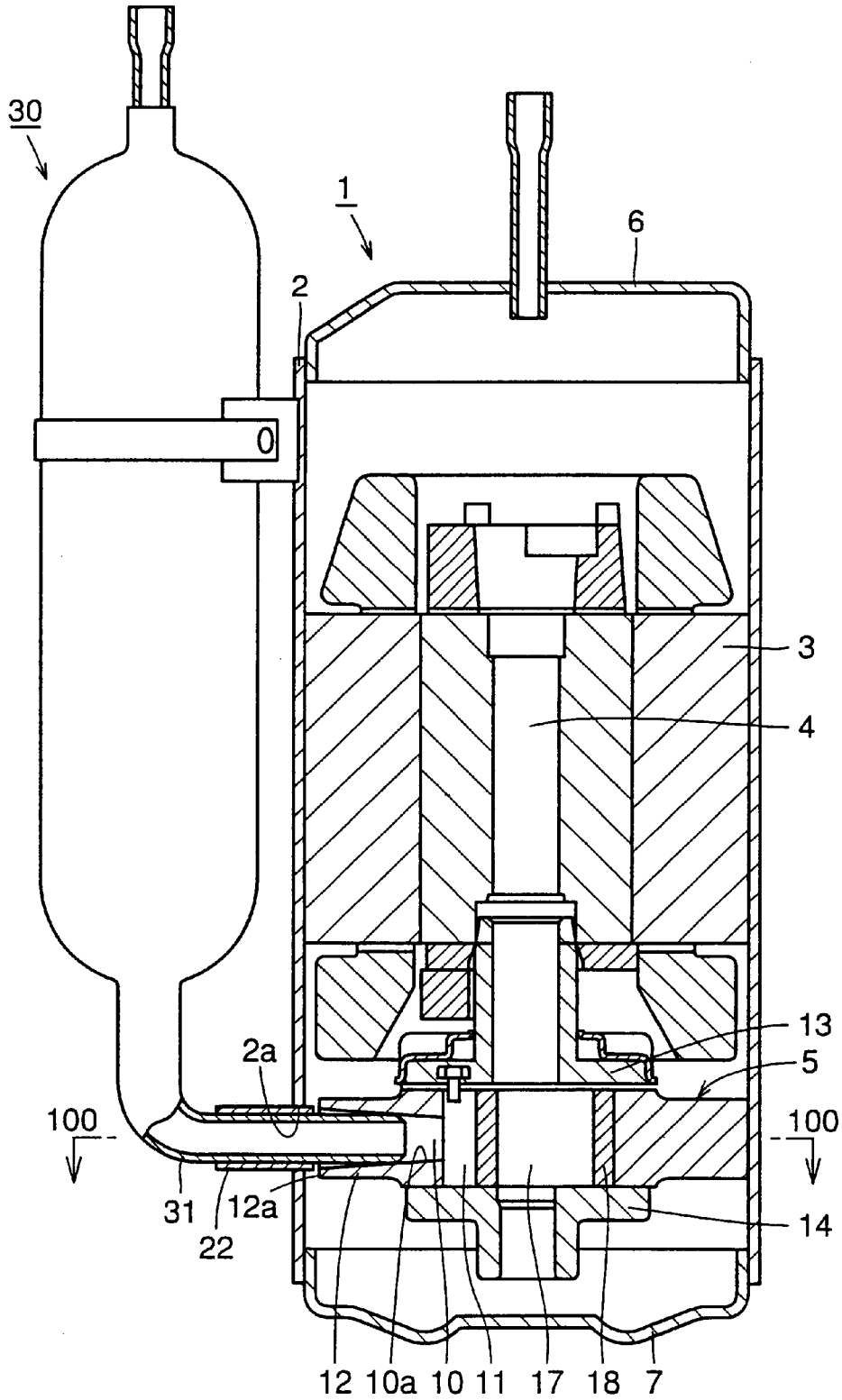
FIG. 1 is a longitudinal sectional view showing the overall structure of a rotary compressor according to a first embodiment of the present invention.

Referring to FIG. 1, a closed rotary compressor 1 according to a first embodiment of the present invention comprises an iron body shell (casing) 2, a motor (electric element) 3, a crank shaft 4, a compression element 5, an upper shell 6 and a lower shell 7. The motor 3 is arranged in an upper portion in the body shell 2. The compression element 5 is coupled to a lower portion of the motor 3 through the crank shaft 4. An accumulator 30 is arranged on a side portion of the rotary compressor 1.

Figure 2:
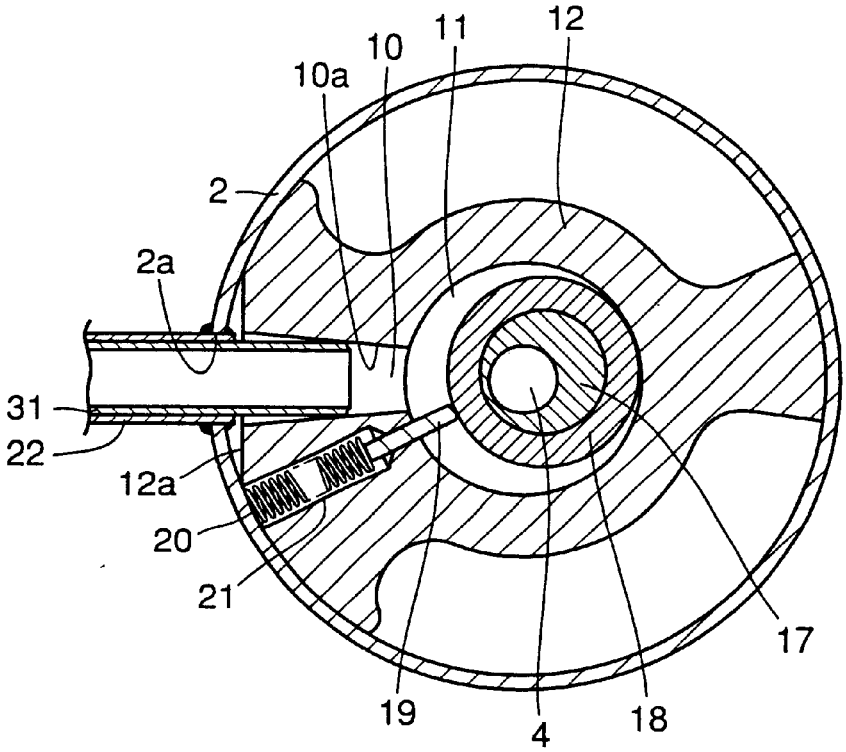
FIG. 2 is a sectional view taken along the line 100—100 in FIG. 1.

Referring to FIGS. 1 and 2, the compression element 5 includes a cylinder 12, an upper bearing 13, a lower bearing 14 and a roller (piston) 18. The cylinder 12 has a refrigerant suction port 10 and a refrigerant compression space 11. The upper bearing 13 and the lower bearing 14 are fixed to upper and lower portions of the cylinder 12 respectively. The roller 18 is rotatably stored in the refrigerant compression space 11 of the cylinder 12, and fixed to an eccentric part 17 of the crank shaft 4.

As shown in FIG. 2, the compression element 5 has a vane 19 and a vane spring 20. The vane spring 20 is inserted into a spring insertion hole 21 formed in the cylinder 12, and guided by the spring insertion hole 21. The vane 19 has a function of separating the refrigerant compression space 11 of the cylinder 12 into a highpressure chamber and a low-pressure chamber by reciprocating following rotary motion of the roller 18. The vane spring 20 has a function of pressing the vane 19 against the roller 18 and sliding the vane 19 with respect to the roller 18.

As shown in FIGS. 1 and 2, a refrigerant flow pipe (inner pipe) 31 of the accumulator 30 is connected to the refrigerant suction port 10 of the cylinder 12 through a connection hole 2*a* of the body shell 2. The compression element 5 compresses a refrigerant supplied from the refrigerant flow pipe 31 into the refrigerant compression space 11 by rotation of the roller 18.

Figure 3:
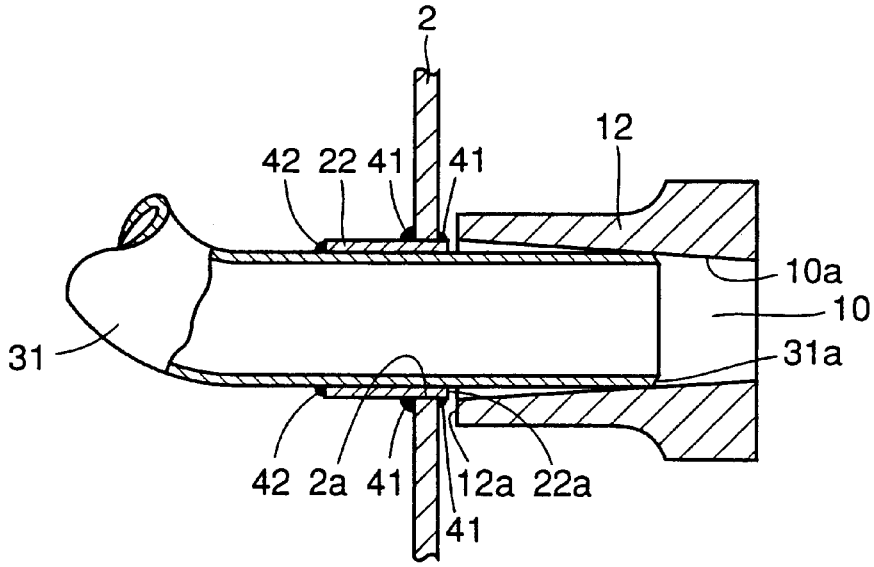
FIG. 3 is an enlarged sectional view of a pipe connection part of the rotary compressor according to the first embodiment shown in FIGS. 1 and 2.

With reference to FIGS. 1 to 3, the structure of a pipe connection part of the rotary compressor 1 according to the first embodiment is now described in detail. The iron body shell 2 is provided with the connection hole 2*a*. The connection hole 2*a* is formed substantially flush with the outer surface of the body shell 2, and has a flat shape without projecting from the outer surface of the body shell 2. An iron body liner (cylindrical body) 22 is engaged into the connection hole 2*a*. The connection hole 2*a* has an inner diameter larger than that of the body liner 22 by about 0.15 mm to 0.3 mm. An end 22*a* of the body liner 22 is arranged to project from the inner surface of the body shell 2 by about 2 mm. The body liner 22 has a function of relaxing transmission of vibration of the body shell 2 to the refrigerant flow pipe 31 of the accumulator 30.

The refrigerant flow pipe 31 of the accumulator 30 passes through the body liner 22, and is press-fitted into the refrigerant suction port 10 of the cylinder 12. A tapered part 10*a* is formed over the entire inner surface of the refrigerant suction port 10. This tapered part 10*a* is inclined with a diameter change and a length in a ratio of 8/1000 to 12/1000. As shown in FIG. 3, a chamfered part 31*a* of at least 0.5 mm is formed on the forward end portion of the refrigerant flow pipe 31.

As shown in FIGS. 2 and 3, a flat surface part 12*a* is formed on an end of the cylinder 12 closer to the connection hole 2*a*. This flat surface part 12*a* defines a reference plane for checking the inclination of the tapered part 10*a* after formation on the refrigerant suction port 10.

As shown in FIG. 3, the iron body shell 2 and the copper body liner 22 are fixed to each other by brazing 41 with silver solder. The copper body liner 2 and the copper refrigerant flow pipe 31 are fixed to each other by brazing 42 with phosphor copper solder.

Figure 19:
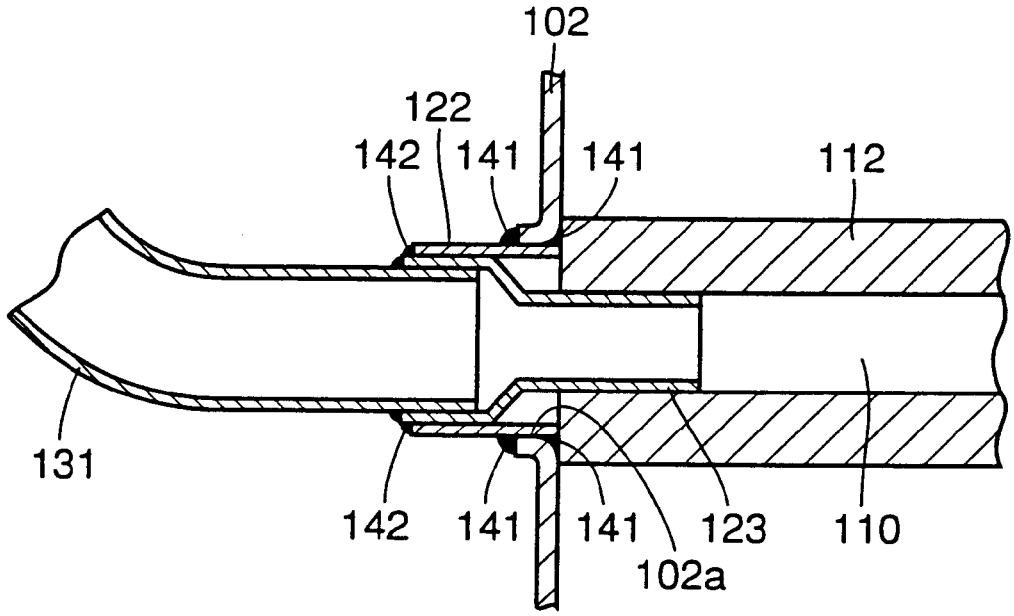
FIG. 19 PRIOR ART
FIG. 19 is an enlarged sectional view of a pipe connection part of the conventional rotary compressor shown in FIG. 18.

According to the first embodiment, the connection hole 2*a* of the body shell (casing) 2, which is formed substantially flush with the outer surface of the body shell 2 without projecting from the outer surface of the body shell 2, can be formed by only perforation with no requirement for burring or the like after the perforation. Consequently, the step of forming the connection hole 2*a* can be simplified and the manufacturing cost can be reduced. According to the first embodiment, further, the refrigerant flow pipe 31 of the accumulator 30 is press-fitted into the refrigerant suction port 10 of the cylinder 12, whereby no conventional pump liner 123 (see FIG. 19) is required for connecting the refrigerant flow pipe 31 and the refrigerant suction port 10 while the number of components as well as the number of assembly steps can be reduced. According to the structure of the first embodiment, therefore, it is possible to provide the rotary compressor 1 which can reduce the number of components and simplify the step of forming the connection hole 2*a*.

According to the first embodiment, further, the refrigerant suction port 10 is formed to include the tapered part 10*a*, which absorbs dispersion of the outer diameter of the refrigerant flow pipe 31 when the refrigerant flow pipe 31 is press-fitted into the refrigerant suction port 10. Thus, even if the outer diameter of the refrigerant flow pipe 31 is dispersed, a substantially uniform press-fit margin can be obtained. If the refrigerant flow pipe 31 is press-fitted into an untapered refrigerant suction port 10 having a straight shape, the forward end portion of the refrigerant flow pipe 31 may be stripped off and pulverized into fine crushed powder (foreign matter), which may exert a bad influence on the performance of the rotary compressor 1 when entering the rotary compressor 1. According to the first embodiment, the tapered part 10*a* is so provided on the refrigerant suction port 10 that the forward end portion of the refrigerant flow pipe 31 can be prevented from being stripped off. According to the first embodiment, further, the forward end portion of the refrigerant flow pipe 31 can be prevented from being stripped off also by providing the chamfered part 31*a* on the forward end portion of the refrigerant flow pipe 31. In the first embodiment, therefore, the refrigerant flow pipe 31 of the accumulator 30 can be smoothly and readily press-fitted into the refrigerant suction port 10 due to the synergistic effect of the tapered part 10*a* of the refrigerant suction port 10 and the chamfered part 31*a* of the refrigerant flow pipe 31.

According to the first embodiment, a portion of the cylinder 12 opposed to the connection hole 2*a* includes the flat surface part 12*a*, whereby the inclination accuracy of the tapered part 10*a* can be readily checked with reference to the flat surface part 12 after formation of the tapered part 10*a*, for keeping the accuracy of the tapered part 10*a* uniform.

According to the first embodiment, the end 22*a* of the body liner 22 is arranged to project from the inner surface of the body shell 2 by about 2 mm, whereby part of the silver solder for brazing the body liner 22 to the outer surface of the body shell 2 in a manufacturing process described later penetrates into the body shell 2 from the outer surface thereof through the connection hole 2*a* of the body shell 2, and the penetrating part of the silver solder is located between the surface of the projecting part of the body liner 22 and the inner surface of the body shell 2. Thus, the body liner 22 and the body shell 2 are brazed to each other on both the outer and inner surfaces of the body shell 2, whereby the bonding strength between the body liner 22 and the body shell 2 can be further improved.

The manufacturing process for the rotary compressor 1 according to the first embodiment is now described with reference to FIGS. 1 to 10.

Figure 4:
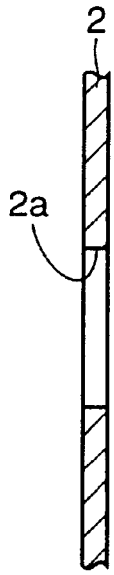
FIG. 4 is a sectional view for illustrating a manufacturing process for the pipe connection part of the rotary compressor according to the first embodiment shown in FIG. 3.

As shown in FIG. 4, perforation such as press working is first performed on the body shell 2, thereby forming the connection hole 2*a* having a flat shape not projecting from the outer surface of the body shell 2. The connection hole 2*a* is formed to have an inner diameter larger than the outer diameter of the body liner 22 by about 0.15 mm to 0.3 mm.

Figure 5:
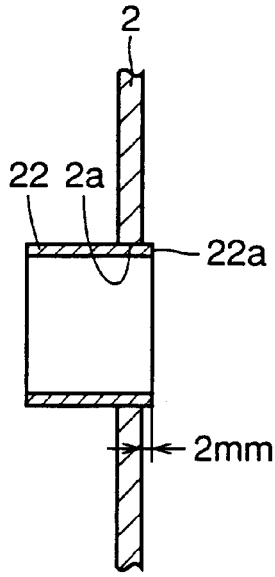
FIG. 5 is a sectional view for illustrating the manufacturing process for the pipe connection part of the rotary compressor according to the first embodiment shown in FIG. 3.
Figure 6:
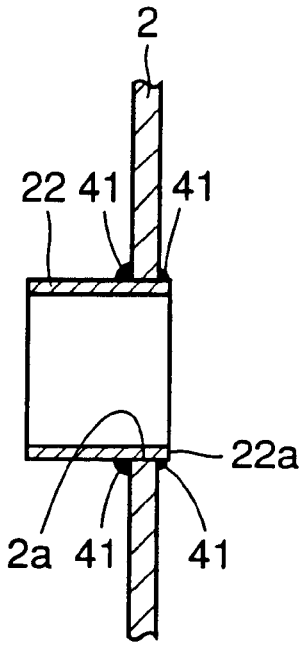
FIG. 6 is a sectional view for illustrating the manufacturing process for the pipe connection part of the rotary compress according to the first embodiment shown in FIG. 3.
Figure 7:
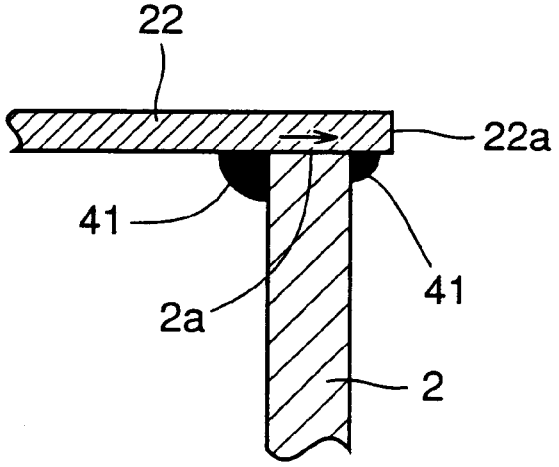
FIG. 7 is a sectional view for illustrating details of brazing with silver solder shown in FIG. 6.

Then, the body liner 22 is inserted into the connection hole 2*a*, as shown in FIG. 5. At this time, the end 22*a* of the body liner 22 is arranged to project from the inner surface of the body shell 2 by about 2 mm.

Thereafter the copper body liner 22 and the outer surface of the iron body shell 2 are fixed to each other by brazing 41 with silver solder. This brazing 41 is performed with silver solder (Mizuno Handy Harmar B-Ag-4) at a temperature of 780° C. to 900° C. for 20 seconds to 30 seconds. The brazing 41 requires no large-scale equipment dissimilarly to welding, and is superior in workability to welding. When brazing the copper body liner 22 and the outer surface of the iron body shell 2 to each other, part of the silver solder flows along arrow shown in FIG. 7 through the connection hole 2*a* of the body shell 2, to penetrate into the body shell 2. The penetrating part of the silver solder is located between the outer peripheral surface closer to the projecting end 22*a* of the body liner 22 and the inner surface of the body shell 2. Thus, the body liner 22 and the body shell 22 are brazed/bonded to each other on both the outer and inner surfaces of the body shell 2, whereby the bonding strength between the body liner 22 and the body shell 22 can be further improved.

Figure 8:
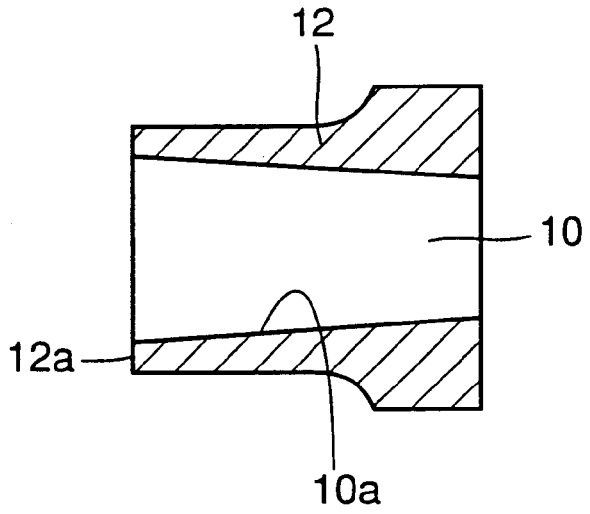
FIG. 8 is a sectional view for illustrating the manufacturing process for the pipe connection part of the rotary compressor according to the first embodiment shown in FIG. 3.

Then, the flat surface part 12*a* is formed on the portion of the cylinder 12 opposed to the connection hole 2*a*, as shown in FIG. 8. Further, the refrigerant suction port 10 having the tapered part 10*a* over the whole is formed on the cylinder 12. The tapered part 10*a* of the refrigerant suction port 10 is formed to have inclination with a diameter change and a length in the ratio of 8/1000 to 12/1000. After formation of the tapered part 10*a*, whether or not the tapered part 10*a* is inclined as designed is checked with reference to the flat surface part 12*a*. Thus, the accuracy of the tapered part 10*a* can be kept substantially uniform.

Figure 9:
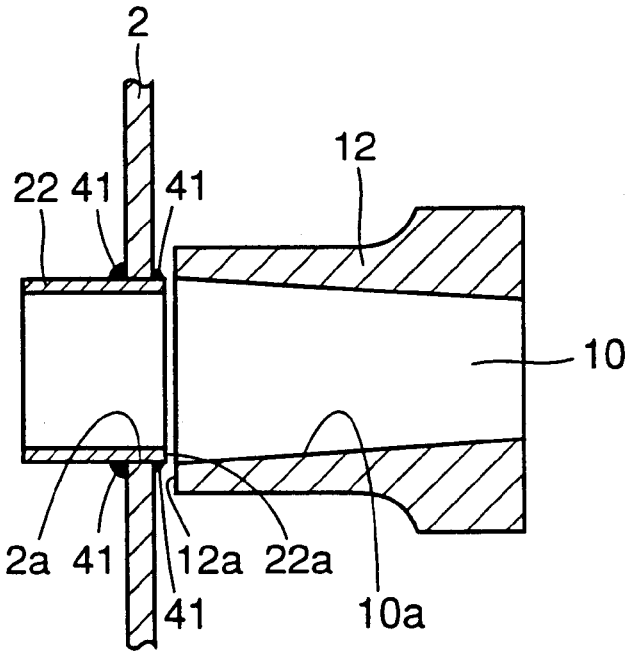
FIG. 9 is a sectional view for illustrating the manufacturing process for the pipe connection part of the rotary compressor according to the first embodiment shown in FIG. 3.

Thereafter the cylinder 12 is inserted into the body shell 2, as shown in FIG. 9. At this time, the flat surface part 12*a* of the cylinder 12 is arranged at a space of about 0.5 mm from the end 22*a* of the body liner 22. Thereafter the cylinder 12 is fixed to a prescribed portion (not shown) of the body shell 2 by three-point welding. According to the first embodiment, the cylinder 12 is inserted into the body shell 2 after the body liner 22 and the body shell 2 are brazed to each other, so that heat generated in brazing of the body liner 22 and the body shell 2 is not conducted to the cylinder 12. Thus, the cylinder 12 can be prevented from distortion resulting from heat generated in brazing of the body liner 22 and the body shell 2. After the cylinder 12 is fixed to the body shell 2 as described above, the upper shell 6 and the lower shell 7 shown in FIG. 1 are mounted on the body shell 2 and fixed by welding.

Figure 10:
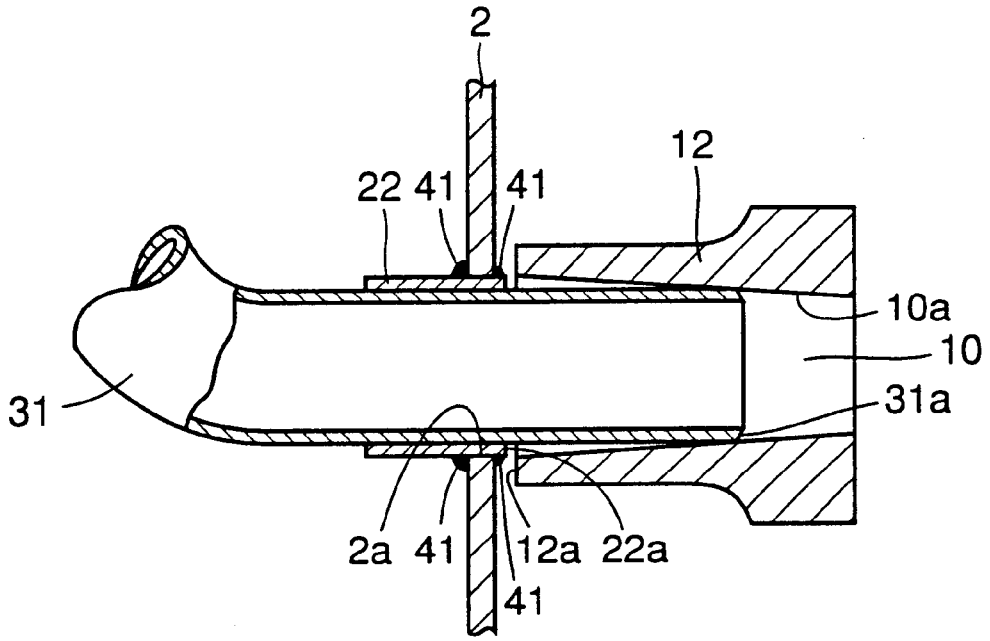
FIG. 10 is a sectional view for illustrating the manufacturing process for the pipe connection part of the rotary compressor according to the first embodiment shown in FIG. 3.

Then, the refrigerant flow pipe 31 of the accumulator 30 is press-fitted into the refrigerant suction port 10 of the cylinder 12 with force of 100 kg to 200 kg, as shown in FIG. 10. As hereinabove described, the chamfered part 31*a* is formed on the forward end portion of the refrigerant flow pipe 31 while the refrigerant suction port 10 has the tapered part 10*a*, whereby the forward end portion of the refrigerant flow pipe 31 press-fitted into the refrigerant suction port 10 can be prevented from being stripped off and pulverized into fine crushed powder (foreign matter), which may exert a bad influence on the performance of the rotary compressor 1 when entering the rotary compressor 1. Even if the outer diameter of the refrigerant flow pipe 31 press-fitted into the refrigerant suction port 10 is dispersed, the tapered part 10*a* absorbs such dispersion, whereby a substantially uniform press-fit margin can be obtained.

Finally, the copper refrigerant flow pipe 31 and the copper body liner 22 are fixed to each other by the brazing 42 with phosphor copper solder. This brazing 42 is performed with phosphor copper solder (Mizuno Handy Harmar AB-Cu-3) at a temperature of 720° C. to 815° C. for 10 to 20 seconds.

Thus, the rotary compressor 1 according to the first embodiment is completed.

(Second Embodiment)

Figure 11:
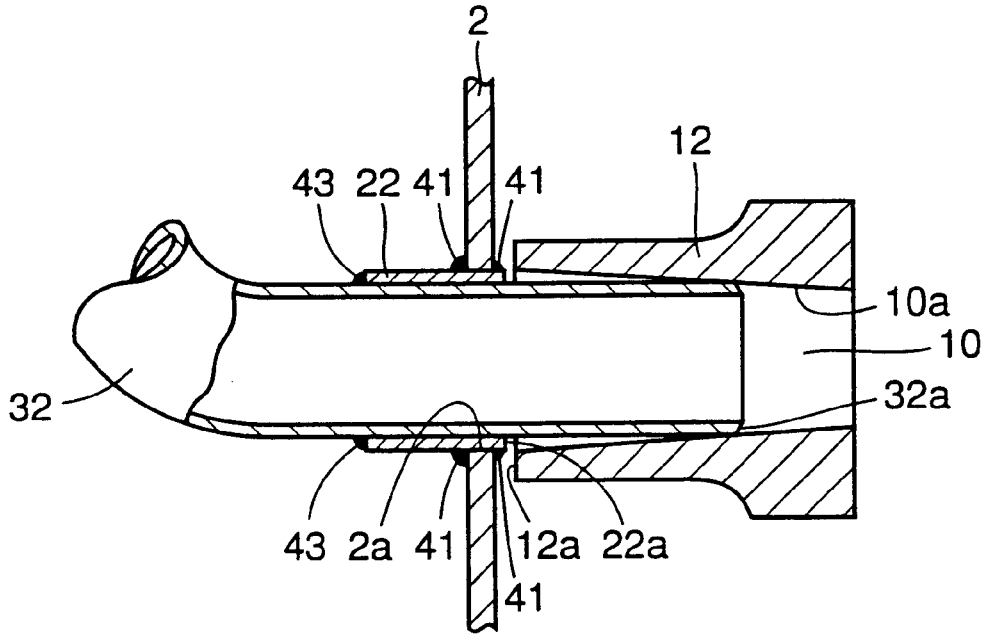
FIG. 11 is an enlarged sectional view of a pipe connection part of a rotary compressor according to a second embodiment of the present invention.

Referring to FIG. 11, a second embodiment of the present invention is basically similar in structure to the aforementioned first embodiment. In the second embodiment, however, a refrigerant flow pipe 32 of an accumulator 30 is made of iron, dissimilarly to the first embodiment. In the second embodiment, therefore, the refrigerant flow pipe 32 and a body liner 22 of copper are fixed to each other by brazing 43 with silver solder. Conditions for the brazing 43 with silver solder are identical to those for the brazing step with silver solder in the first embodiment shown in FIG. 6. Thus, according to the second embodiment 2, not only a body shell 2 and the body liner 22 but also the refrigerant flow pipe 32 and the body liner 22 are fixed to each other by brazing 41 and the brazing 43 with silver solder, whereby the workability of the brazing step can be improved as compared with the first embodiment employing two types of brazing filler metals, i.e., silver solder and phosphor copper solder.

According to the second embodiment basically similar in structure to the first embodiment as described above, effects similar to those of the first embodiment can be attained. A connection hole 2*a* of the body shell (casing) 2 is formed substantially flush with the outer surface of the body shell 2 without projecting from the outer surface of the body shell 2 so that no burring or the like may be performed after perforation for forming the connection hole 2*a*, whereby the step of forming the connection hole 2*a* can be simplified. Further, the refrigerant flow pipe 32 of the accumulator 30 is press-fitted into a refrigerant suction port 10 of a cylinder 12, whereby no conventional pump liner 123 (see FIG. 19) is required for connecting the refrigerant flow pipe 32 and the refrigerant suction port 10 and the number of components as well as the number of assembly steps can be reduced. In addition, the refrigerant suction port 10 is formed to include a tapered part 10*a*, whereby a substantially uniform press-fit margin can be obtained even if the outer diameter of the refrigerant flow pipe 32 is dispersed. Further, the refrigerant flow pipe 32 of the accumulator 30 can be smoothly and readily press-fitted into the refrigerant suction port 10 due to the synergistic effect of the tapered part 10*a* of the refrigerant suction port 10 and a chamfered part 32*a* of the refrigerant flow pipe 32.

A portion of the cylinder 12 opposed to the connection hole 2*a* is formed to include a flat surface part 12*a*, so that the inclination accuracy of the tapered part 10*a* can be readily checked with reference to the flat surface part 12*a* after formation of the tapered part 10*a*, whereby the accuracy of the tapered part 10*a* can be kept uniform. An end 22*a* of the body liner 22 is arranged to project from the inner surface of the body shell 2 by about 2 mm so that part of the silver solder for brazing the body liner 22 to the outer surface of the body shell 2 penetrates into the body shell 2 from the outer surface of the body shell 2 through the connection hole 2*a*, whereby the body liner 22 and the body shell 2 are brazed to each other on both the outer and inner surfaces of the body shell 2 and the bonding strength between the body liner 22 and the body shell 2 can be further improved.

(Third Embodiment)

Figure 12:
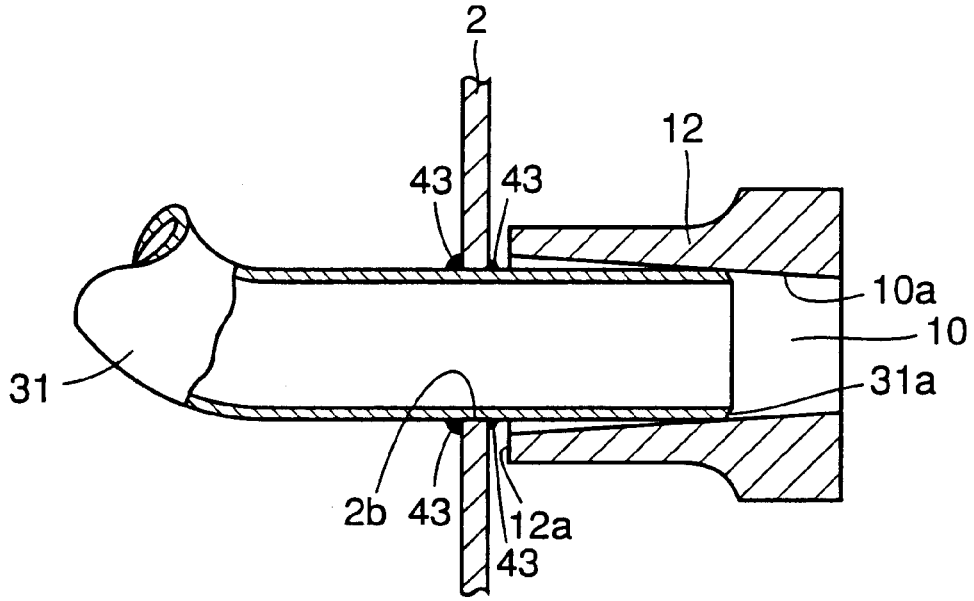
FIG. 12 is an enlarged sectional view of a pipe connection part of a rotary compressor according to a third embodiment of the present invention.

Referring to FIG. 12, a third embodiment of the present invention has a structure obtained by omitting the body liner 22 (see FIG. 3) from the structure of the aforementioned first embodiment.

More specifically, a refrigerant flow pipe 31 of copper is directly press-fitted into a refrigerant suction port 10 of a cylinder 12, while the refrigerant flow pipe 31 is directly fixed to a body shell 2 by brazing 43 with silver solder. According to the third embodiment, therefore, not only a pump liner but also the body liner 22 can be omitted, and the number of components can be further reduced as compared with the first embodiment. In the third embodiment, the inner diameter of a connection hole 2*b* is larger than the outer diameter of the refrigerant flow pipe 31 by about 3 mm, dissimilarly to the connection holes 2*a* in the first and second embodiments.

Figure 13:
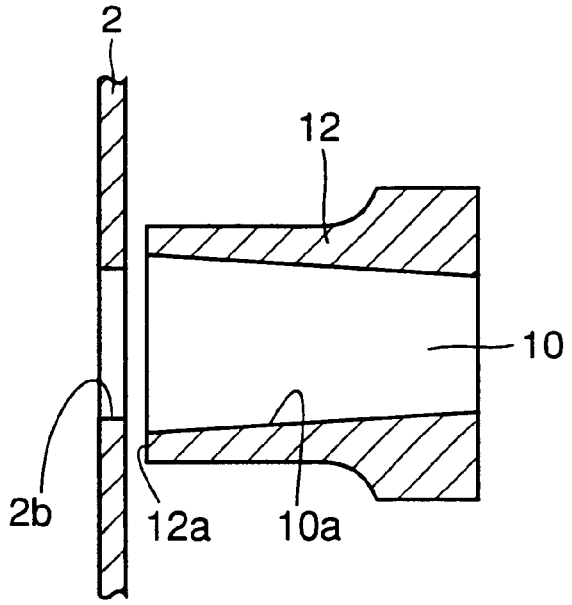
FIG. 13 is a sectional view for illustrating a manufacturing process for the pipe connection part of the rotary compressor according to the third embodiment shown in FIG. 12.
Figure 14:
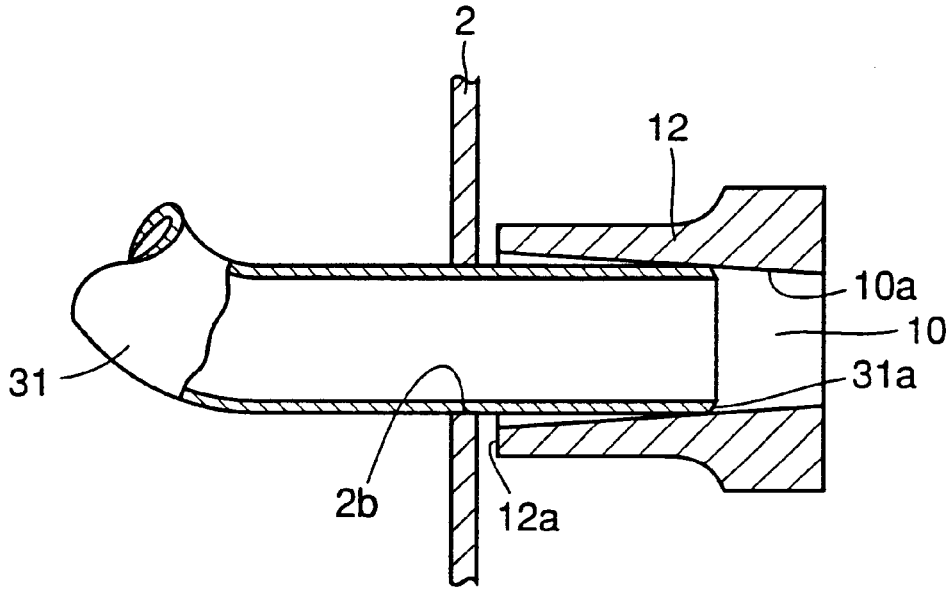
FIG. 14 is a sectional view for illustrating the manufacturing process for the pipe connection part of the rotary compressor according to the third embodiment shown in FIG. 12.

In a manufacturing process for the third embodiment, perforation such as press working is first performed on the body shell 2, thereby forming the connection hole 2*b* having a flat shape not projecting from the outer surface of the body shell 2, as shown in FIG. 13. This connection hole 2*b* is formed to have an inner diameter larger than the outer diameter of the refrigerant flow pipe 31 by about 0.15 to 0.3 mm. Thereafter the cylinder 12 including the refrigerant suction port 10 having a tapered part 10*a* and a flat surface part 12*a* is inserted into the body shell 2. The cylinder 12 is fixed to a prescribed portion (not shown) of the body shell 2 by three-point welding.

Then, the refrigerant flow pipe 31 is press-fitted into the refrigerant suction port 10 through the connection hole 2*b* with force of 100 kg to 200 kg. Thereafter the refrigerant flow pipe 31 of copper and the body shell 2 of iron are fixed to each other by the brazing 43 with silver solder, as shown in FIG. 12. The brazing 43 with silver solder is performed under conditions similar to those for the brazing step with silver solder in the first embodiment shown in FIG. 6. Thus, a rotary compressor according to the third embodiment is completed. In the manufacturing process for the third embodiment, a step of inserting and fixing the body liner 22 into and to the body shell 2 can be omitted, whereby the manufacturing process can be simplified as compared with the first embodiment.

(Fourth Embodiment)

Figure 15:
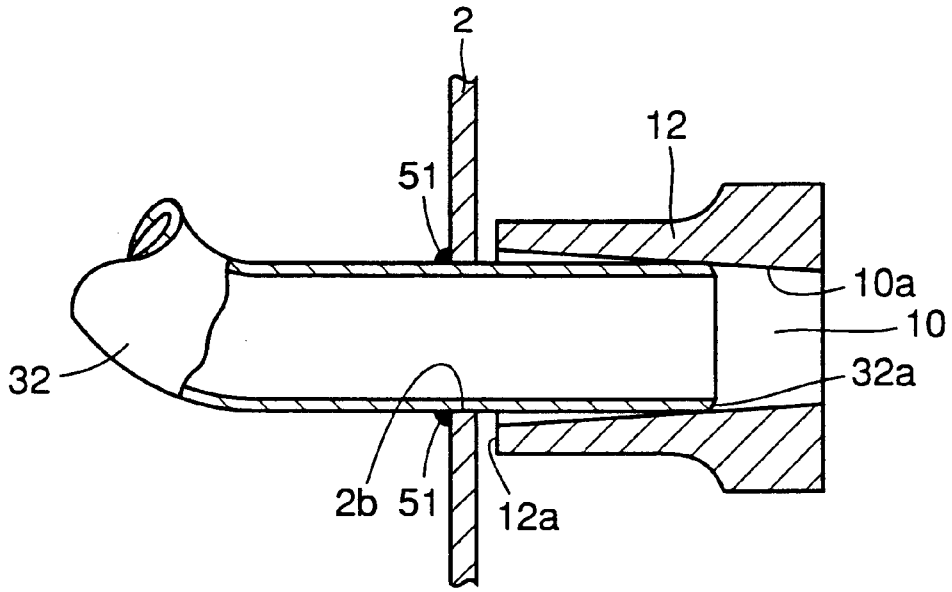
FIG. 15 is an enlarged sectional view of a pipe connection part of a rotary compressor according to a fourth embodiment of the present invention.

Referring to FIG. 15, a fourth embodiment of the present invention is basically similar in structure to the aforementioned third embodiment. In the fourth embodiment, however, a refrigerant flow pipe 32 is made of iron, dissimilarly to the third embodiment. According to the fourth embodiment, therefore, the refrigerant flow pipe 32 and a body shell 2 of iron are fixed to each other by welding 51. This welding 51 is performed under conditions of 7800 to 900° C. and 10 seconds to 15 seconds. The welding 51 has higher bonding strength as compared with brazing, and hence the bonding strength between the refrigerant flow pipe 32 and the body shell 2 can be further improved.

According to the fourth embodiment basically similar in structure to the third embodiment as described above, effects similar to those of the third embodiment can be attained. According to the fourth embodiment, not only a pump liner but also the body liner 22 can be omitted, whereby the number of components can be reduced and a manufacturing process can be simplified as compared with the first embodiment.

(Fifth Embodiment)

Figure 16:
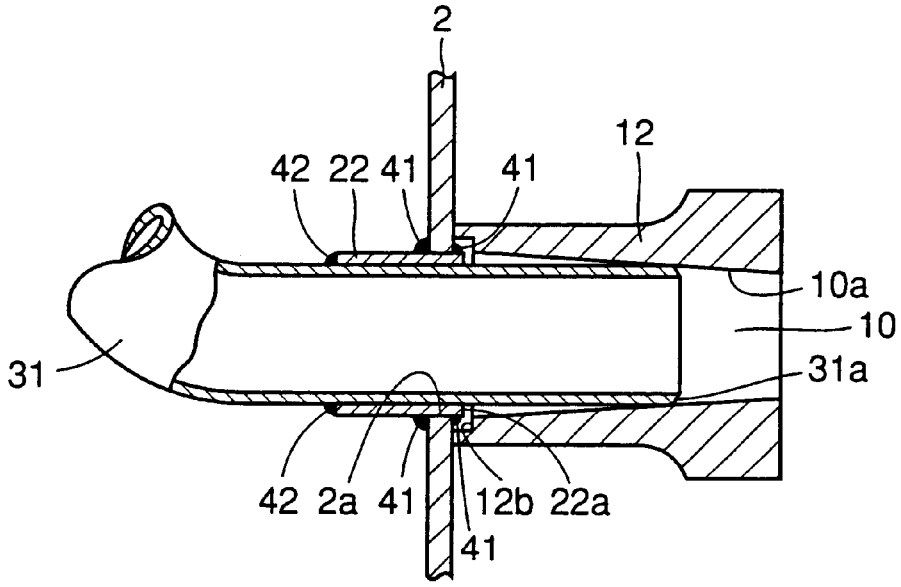
FIG. 16 is an enlarged sectional view of a pipe connection part of a rotary compressor according to a fifth embodiment of the present invention.
Figure 17:
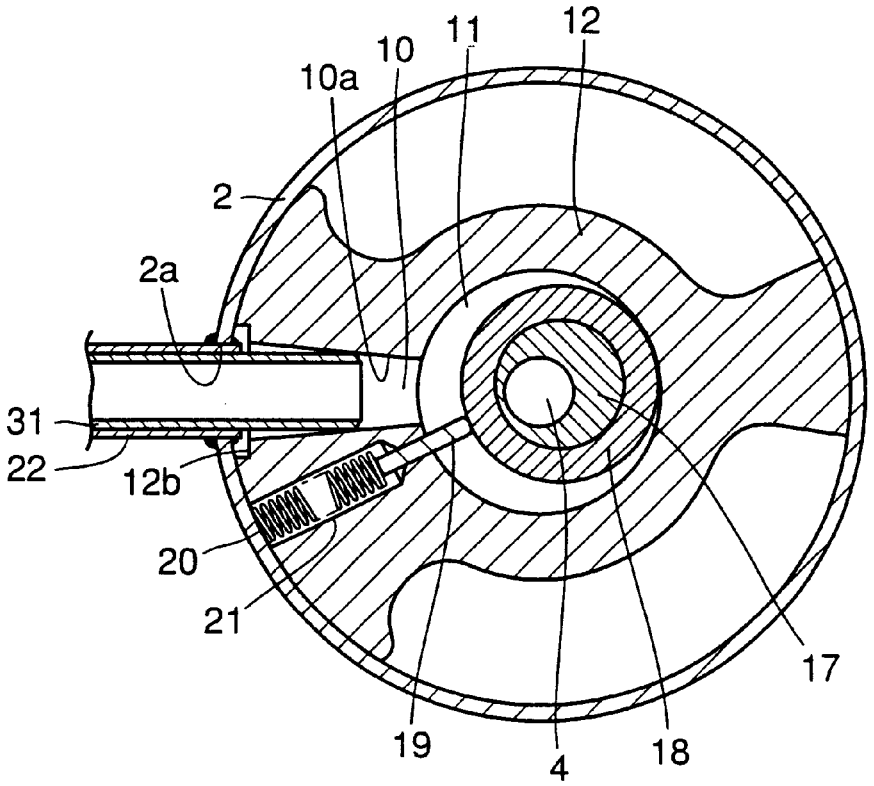
FIG. 17 a a cross-sectional view of the rotary compressor according to the fifth embodiment of the present invention.
Figure 18:
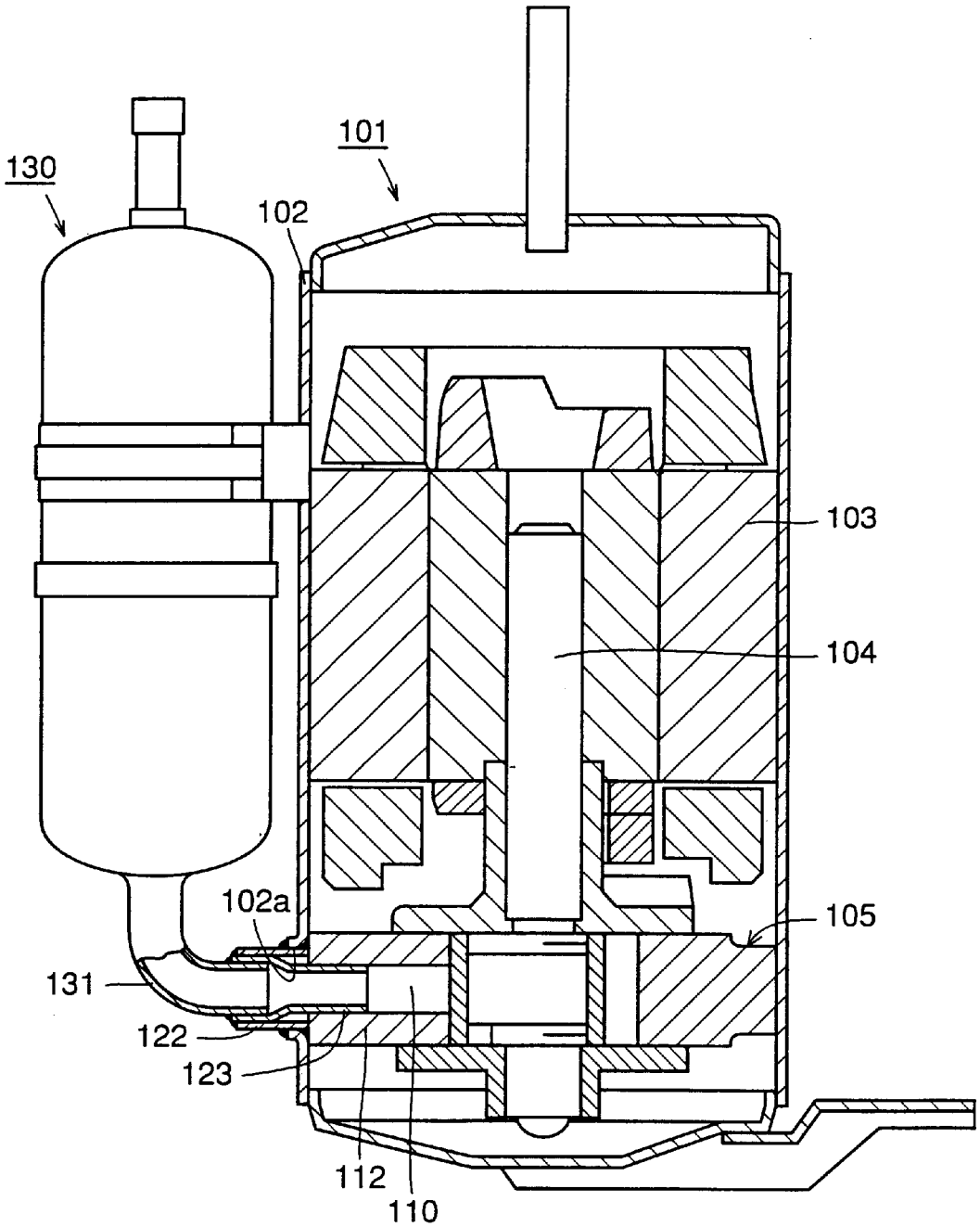
FIG. 18 PRIOR ART
FIG. 18 is a longitudinal sectional view showing the overall structure of a conventional rotary compressor.

Referring to FIGS. 16 and 17, a fifth embodiment of the present invention is basically similar in structure to the first embodiment. In the fifth embodiment, however, a spot facing flat surface part 12*b* is provided in place of the flat surface part 12*a* of the first embodiment. The spot facing depth of the spot facing flat surface part 12*b* is about 2.5 mm, and the inner diameter of a spot facing hole is so designed that the inner surface of the spot facing hole is not in contact with silver solder of brazing 41 on the inner surface of a body shell 2. The spot facing flat surface part 12*b* forms the flat surface part of the present invention, and attains an effect similar to that of the flat surface part 12*a* in the first embodiment. In other words, the accuracy of inclination of a tapered part 10*a* of a refrigerant suction port 10 can be readily checked with reference to the spot facing flat surface part 12*b* after formation of the tapered part 10*a*, whereby the accuracy of the tapered part 10*a* can be kept substantially uniform. According to the fifth embodiment basically similar in structure to the first embodiment, various effects similar to those of the first embodiment can be attained.

Although the present invention has been described and illustrated in detail, it is clearly understood that the same is by way of illustration and example only and is not to be taken by way of limitation, the spirit and scope of the present invention being limited only by the terms of the appended claims. While the fifth embodiment is based on the structure of the first embodiment and provided with the spot facing flat surface part 12*b* in place of the flat surface part 12*a*, for example, the present invention is not restricted to this but a similar effect can be attained by employing the spot facing flat surface part 12*b* in place of the flat surface part 12*a* in each of the structures of the second to fourth embodiments.

What is claimed is:

1. A compressor comprising:

a compression element having a refrigerant suction port connected with a refrigerant flow pipe of an accumulator;

a casing having an outer surface formed to enclose said compression element and having a connection hole in a portion opposed to said refrigerant suction port, wherein said connection hole is formed substantially flush with said outer surface of said casing without projecting from said outer surface of said casing;

a forward end portion of said refrigerant flow pipe having an outer surface, said refrigerant flow pipe of said accumulator having an untapered straight shape; and said refrigerant suction port includes a tapered part, a forward end portion of said refrigerant flow pipe includes a beveled or chamfered edge wherein said chamfered edge has a shape to allow said forward end portion of said refrigerant flow pipe to be inserted, by press-fitting, into said tapered part of said refrigerant suction port.

2. The compressor in accordance with claim 1, wherein a portion of said compression element opposed to said connection hole includes a flat surface part.

3. The compressor in accordance with claim 1, further comprising a cylindrical body inserted into said connection hole and fixed to said casing, wherein said forward end portion of said refrigerant flow pipe of said accumulator passes through said cylindrical body, and is press-fitted into said refrigerant suction port and fixed to said casing through said cylindrical body.

4. The compressor in accordance with claim 3, wherein part of said cylindrical body projects inward into said casing.

5. The compressor in accordance with claim 3, wherein said cylindrical body is made of copper, said refrigerant flow pipe of said accumulator is made of copper, and said casing is made of iron, said casing and said cylindrical body are fixed to each other by brazing with silver solder, and said cylindrical body and said refrigerant flow pipe of said accumulator are fixed to each other by brazing with phosphor copper solder.

6. The compressor in accordance with claim 3, wherein said cylindrical body is made of copper, said refrigerant flow pipe of said accumulator is made of iron, and said casing is made of iron, said casing and said cylindrical body are fixed to each other by brazing with silver solder, and said cylindrical body and said refrigerant flow pipe of said accumulator are fixed to each other by brazing with silver solder.

7. The compressor in accordance with claim 3, wherein the inner surface of said refrigerant suction port includes a tapered part, said forward end portion of said refrigerant flow pipe of said accumulator includes a chamfered part, and said refrigerant flow pipe of said accumulator is press-fitted into said tapered part of said refrigerant suction port.

8. The compressor in accordance with claim 7, wherein a portion of said compression element opposed to said connection hole includes a flat surface part.

9. The compressor in accordance with claim 1, wherein said forward end portion of said refrigerant flow pipe of said accumulator passes through said connection hole.

10. The compressor in accordance with claim 9, wherein said refrigerant flow pipe of said accumulator is made of copper, and said casing is made of iron, and said casing and said refrigerant flow pipe of said accumulator are fixed to each other by brazing with silver solder.

11. The compressor in accordance with claim 9, wherein said refrigerant flow pipe of said accumulator is made of iron, and said casing is made of iron, and said casing and said refrigerant flow pipe of said accumulator are fixed to each other by welding.

12. The compressor in accordance with claim 9, wherein the inner surface of said refrigerant suction port includes a tapered part, said forward end portion of said refrigerant flow pipe of said accumulator includes a chamfered part, and said refrigerant flow pipe of said accumulator is press-fitted into said tapered part of said refrigerant suction port.

13. The compressor in accordance with claim 12, wherein a portion of said compression element opposed to said connection hole includes a flat surface part.

14. A compressor comprising:

a compression device having a refrigeration suction port connected to a refrigerant flow pipe of an accumulator;

a casing having an outer surface wherein said casing formed to enclose said compression device having a connection hole in a portion opposed to said refrigerant suction port, wherein said connection hole is formed substantially flush with said outer surface of said casing without projecting from said outer surface of said casing;

a forward end portion of said refrigerant flow pipe of said accumulator is inserted into said compression device being affixed to said casing;

a cylindrical body having a body liner, and said cylindrical body is inserted into said connection hole and being fixed to said casing, wherein said forward end portion of said refrigerant flow pipe of said accumulator passes through said cylindrical body and is press-fitted into said refrigeration suction port and affixed to said casing through said cylindrical body;

said body liner being affixed to said refrigerant flow pipe by brazing with silver solder; and said outer surface of said casing being affixed to said body liner by brazing with silver solder.

15. The compressor in accordance with claim 1, wherein said refrigerant flow pipe is made of iron.

16. The compressor in accordance with claim 2, wherein said flat surface part of said compression element includes a spot facing flat surface part (12*b*).

* * * * *